United States Patent [19]

Verducci

[11] Patent Number: 4,744,376

[45] Date of Patent: May 17, 1988

[54] POCKET-CONTAINER FOR COSMETIC PRODUCTS

[75] Inventor: Giovanni Verducci, Monza San Fruttuoso, Italy

[73] Assignee: Gianni Verducci S. r. l., Milan, Italy

[21] Appl. No.: 902,452

[22] PCT Filed: Dec. 18, 1985

[86] PCT No.: PCT/EP85/00717

§ 371 Date: Aug. 13, 1986

§ 102(e) Date: Aug. 13, 1986

[87] PCT Pub. No.: WO86/03659

PCT Pub. Date: Jul. 3, 1986

[30] Foreign Application Priority Data

Dec. 20, 1984 [IT] Italy ..... 24200/84[U]

[51] Int. Cl.[4] ..... A45D 33/00

[52] U.S. Cl. ..... 132/82 C; 132/79 G; 132/83 C; 220/DIG. 26

[58] Field of Search ..... 132/79 F, 79 G, 80 A, 132/82 B, 82 C, 83 C, 82 R; 220/DIG. 26; 206/823

[56] References Cited

U.S. PATENT DOCUMENTS

| | | | |
|---|---|---|---|
| 1,229,286 | 6/1917 | Kendall | 132/83 R |
| 1,336,216 | 4/1920 | Garbeil | 132/83 R |
| 1,654,271 | 12/1927 | Schuelke et al. | 132/83 R |
| 1,731,008 | 10/1929 | Hauch | 220/DIG. 26 |
| 1,735,183 | 11/1929 | Salerno | 132/79 F |
| 1,866,162 | 7/1932 | Hall | 132/83 C |
| 2,037,912 | 4/1936 | Lisner | 220/DIG. 26 |
| 2,597,473 | 5/1952 | Green et al. | 132/79 G |
| 2,712,318 | 7/1955 | Root | 132/83 R |
| 4,526,273 | 7/1985 | Tsuji et al. | 132/79 G |

FOREIGN PATENT DOCUMENTS

| | | | |
|---|---|---|---|
| 430490 | 10/1911 | France | 132/79 F |

*Primary Examiner*—John J. Wilson
*Assistant Examiner*—Cary E. Stone
*Attorney, Agent, or Firm*—Diller, Ramik & Wight

[57] ABSTRACT

A pocket container for cosmetic products including a box-shape body defined by a bottom wall, two side walls and a rear wall, first and second covers pivotally connected to the body along opposite parallel pivots, a drawer slidable beneath the bottom wall and generally parallel to axes of the pivots, and the covers being in mating overlapping relationship along edge portions abutting each other along a plane in oblique relationship to the bottom wall whereby one of the covers overlappingly retains the other of the covers in its closed position.

15 Claims, 2 Drawing Sheets

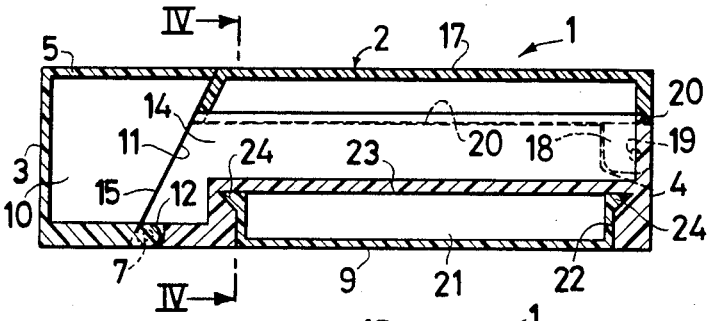
Fig.3
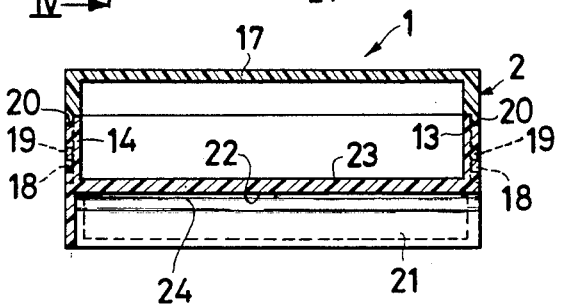
Fig.4
Fig.5
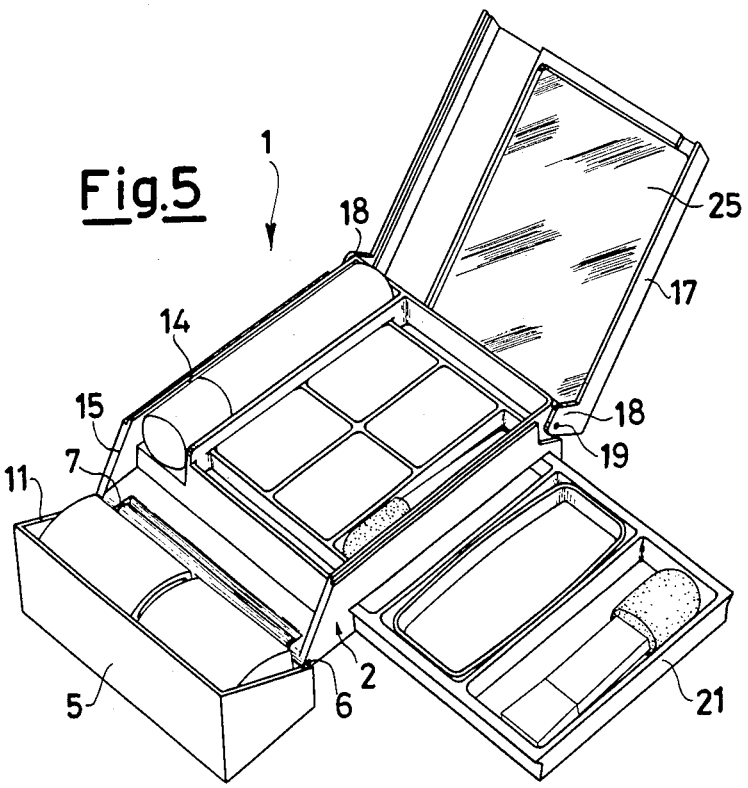

POCKET-CONTAINER FOR COSMETIC PRODUCTS

The present invention relates to a container, in particular, but not exclusively, to a pocket container for cosmetic products, toilet articles and the like.

The containers of such a kind, manufactured in various shapes and sizes, have mostly the drawback of containing a limited number of products or items relatively to containers' overall dimensions.

It can moreover be observed that the greater the number of contained products, the more easily the known containers assume not much practical or manageable shapes, and also the accessibility to various products becomes more problematic.

The main purpose of the present invention is hence to provide a container, in particular a pocket container for cosmetic products or the like, which can contain a number of different products surprisingly great relatively to its dimensions, and whose overall dimensions are limited, and which is practical and functional in use.

Another purpose of the invention is that of proposing an original container, that at a first glance does not let understand its main function, constituting, for a person unacquainted with its contents, a surprise on opening.

In view of the above said purposes a container is proposed according to the invention, in particular, a pocket container for cosmetic products or other similar products, constituted by a box-shaped body of essentially parallelepipedon shape, with an access cover hinged on to the box-shaped body in correspondence of an end portion, and with housings inside said body, for different products, characterized in that in front of said cover a second cover is provided, suitable to open in direction opposite to that of the first cover according to an axis parallel to the hinging axis of the first cover, and that in the zone of the box-shaped body opposite to the second cover a drawer opening on a side of box-shaped body is moreover provided.

Advantageously, the box-shaped body can have the dimensions and the shape of a cigarette box, with the said first cover being constituted by the usual box opening cover, whilst the second cover is hinged in correspondence of the face of the box-shaped body opposite to the said first cover, and the drawer can slide in direction transversal to the box-shaped body.

Such a container can be provided with various housing zones, starting from a zone defined inside the first cover, whilst the cavity under the second cover, as well as the drawer can be suitably subdivided into compartments for the containment of specific products, as it shall be better seen hereinunder.

Further details and characteristics of the invention are indeed more clearly evidenced in the following disclosure of a container according to the invention, shown to exemplifying purposes in the attached drawings, wherein:

FIG. 3 is a section according to path III—III of FIG. 1;

FIG. 4 is a section according to line IV—IV of FIG. 3;

FIG. 5 is an example of complete container, containing, to exemplifying purposes, cosmetic products, in particular toilet articles for ladies.

Figure 1:
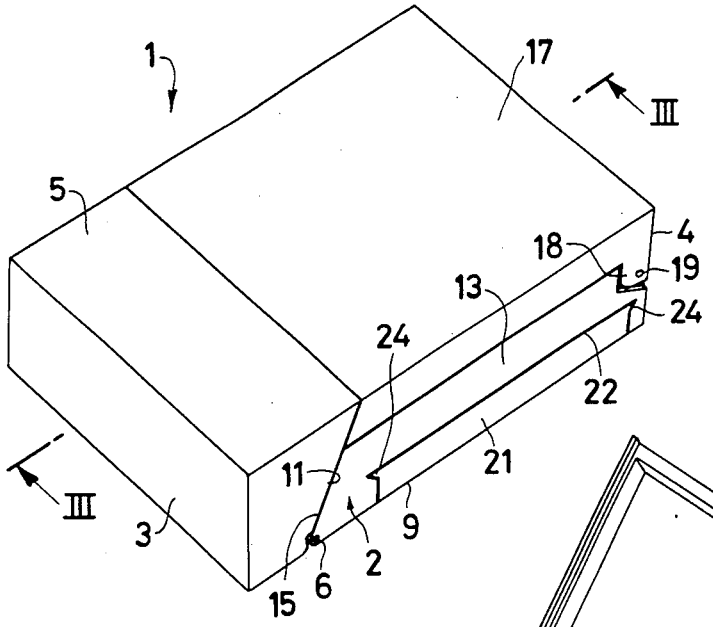
FIG. 1 is a perspective view of the container closed.

The container 1 according to the invention is constituted by a box-shaped body 2, of substantially parallelepipedon shape, with bases 3 and 4 preferably rectangular, and has in the case as shown the dimensions of a normal cigarette box.

It comprises a first access cover 5, positioned in correspondence of and end portion of box-shaped body 2, and hinged, e.g., by means of pivots 6, 7 on to the box-shaped body 2 around an axis 8 positioned transversally relatively to the longitudinal dimension of container 1, on the plane containing one of its longer sides, indicated with 9.

The cover 5 defines within its interior a first housing seat 10, prevailingly extending transversally to the container 1.

As in a normal cigarette box, the edges 11 of cover 5 joining each other in the hinged side 12 run slopingly relatively to a straight line perpendicular to the longer side 9 of container 1, and lay on the plane of side walls 13, 14 of container 1. In a similar way, the edges 15 of the body 2 of the container 1 cooperating with the edges 11 of cover 5 run with a contrary slopingness.

At the end of container 1 opposite to that bearing the cover 5, a second cover 17 is hinged, according to an axis 16 parallel to axis 8, and in a position diagonally opposite relatively to container 1, in particular by means of side flanges 18 connected to the body 2 of container 1 by pivots 19. In such a way, the cover 17 can be open in a direction opposite to that of cover 5.

The cover 17 has side walls which, in its closed position, enter within grooves 20 of side walls 13, 14 of the body 2 of container 1, so that in such a closed position, the side walls of cover 17 result flush with the side walls 13, 14 of the body 2 of container 1. In its front end, the cover 17 is obliquely cut by a plane parallel to axis 16, as the edges 15.

From the body 2 of container 1 a drawer 21 can be moreover extracted, preferably sideways, which finds its housing within a chamber 22 defined under a plane 23 placed inside the body 2 of container 1, in a position opposite to cover 17. The drawer 21 is guided in direction parallel to axes 8 and 16 by means of guides 24 slidingly cooperating with transversal grooves of said chamber 22. The drawer 21 has its bottom flush with the longer base edge 9 of container 1. It can be hence extracted simply by leaning a user's finger on it and then moving it in the direction of guides 24. Its stroke is limited rearwards by the side wall 14 of the body 2 of container 1, while further stops, not shown, are furthermore provided to stop the drawer 21 in its completely protruding position.

The inner plane 23 ends spaced apart from the front edge onto which the cover 5 is hinged, thus defining a space completing the housing cavity 10 of cover 5, when this latter is in its closed position.

The container as disclosed can be provided with compartments inside its inner housing spaces, e.g., as shown in FIG. 5, wherein to exemplifying purposes some items are shown, which may be contained inside the container according to the invention, e.g., eye shadows for eye makeup, blush, lipsticks and lip glosses, colorsticks and mascara and brushes in general, and so forth. Inside the cover 17 a small mirror 25 can be suitably housed. The plurality of objects which occupy the limited space defined by the limited dimensions of container 1 should be noted.

Of course, in lieu of toilet articles for ladies, inside the container toilet articles for gentlemen can be contained, such as shaving cream, disposable razor, or twin-blade razor, or razor with interchangeable blade, shaving brush, perfumed tissue-papers, and so forth.

The container 1 can be advantageously made from plastic material, of various colours. It could also be provided with writings and/or drawings similar or identical to those of a cigarette box, having hence an exterior appearance as of a normal cigarette box, and not letting realize at all its contents to those who do not know it, but, with surprise, on opening.

The user can easily bring with himself the toilet articles he/she needs, as he/she would simply carry a cigarette box. The usefulness is evident of having so many different products in a so limited space.

It should be noted that the compartments inside the useful space of container 1 can be different, as a function of the product the container is destined to house.

Figure 2:
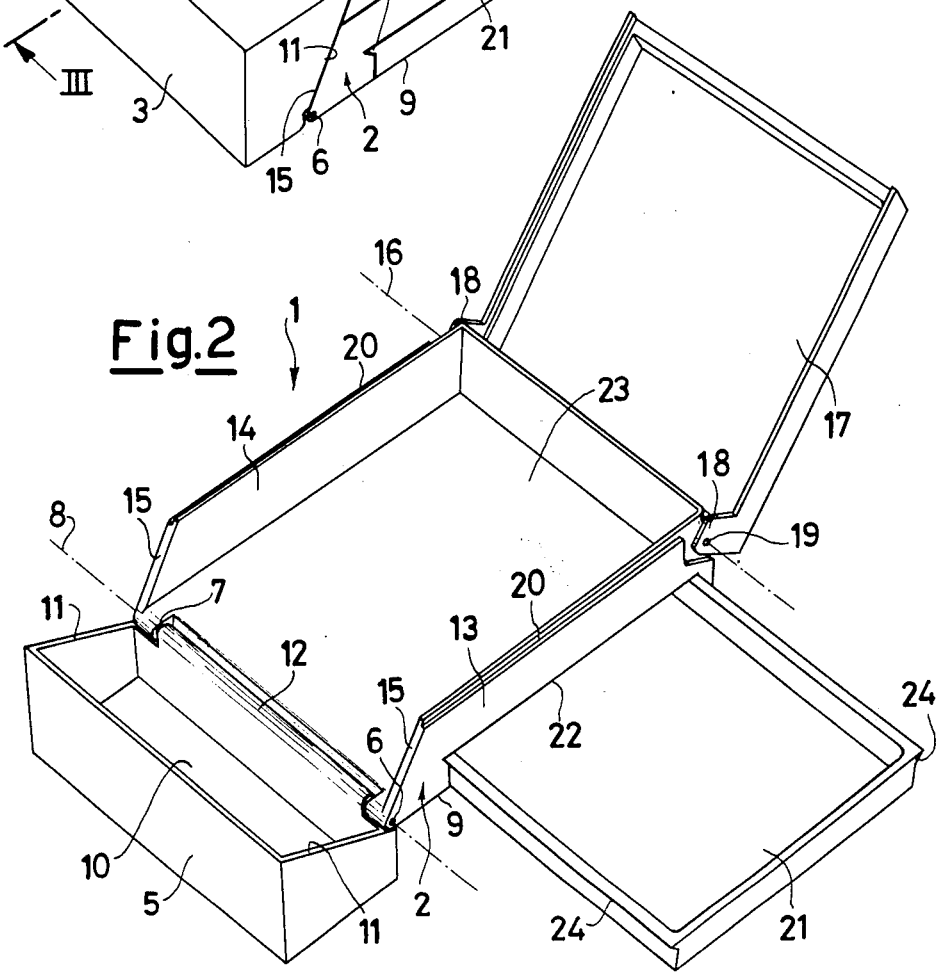
FIG. 2 is a perspective view of the container open, in its simplest embodiment.

It shall be logically possible it to make the drawer 21 extractable from a side face different from the one shown, or from the rear base in FIGS. 1 and 2.

It shall be possible it to hold cover 5 is its closure position e.g. by elastic means, or by snap means easily accomplishable and positionable, as well as drawer 21. The closed position of cover 5 secures also the closed position of facing cover 17, thanks to the sloping cut.

It can be thus understood that the use of container 1 envisages a first step of opening of cover 5, exactly as it occurs with a normal cigarette box.

What is claimed is:

1. A pocket container for cosmetic products or the like comprising a generally box-shaped body of substantially parallel piped configuration; said body including a bottom wall, a pair of generally parallel upstanding side walls and an upstanding rear wall between said side walls; said rear wall being located at a first end of said bottom wall remote from an opposite second end of said bottom wall; a first cover pivotally connected by a first pivot adjacent said first end for pivoting said first cover between relatively open and closed positions in the latter of which a top wall of said first cover is in generally parallel overlying spaced relationship to said bottom wall; a second cover pivotally connected by a second pivot adjacent said second end for pivoting said second cover between relatively open and closed positions in the latter of which a top wall of said second cover is coincident with said first cover top wall, said first and second pivots being disposed in generally parallel relationship to each other, said first and second cover define respective first and second paths of travel of said first and second cover which are directed toward each other when said first and second covers move toward their closed positions, a drawer beneath said bottom wall, means mounting said drawer for sliding movement generally parallel to said first and second pivots, said drawer and second cover each having a bottom wall which are in a generally common plane when said second cover is in its closed position, and said first and second covers having respective first and second edge portions in abutting relationship to each other along a plane in oblique relationship to said bottom wall whereby one of said covers overlappingly retains another of said covers in its closed position.

2. The pocket container as defined in claim 1 wherein said one and second covers are the same.

3. The pocket container as defined in claim 2 wherein said oblique plane defines an acute angle with said generally common plane, and said acute angle opens in a direction toward said first pivot.

4. The pocket container as defined in claim 3 wherein said first cover includes a pair of generally spaced parallel side walls; said drawer includes a front wall; and one of said first cover and body side walls are in a common plane with said drawer front wall in a closed position of said drawer.

5. The pocket container as defined in claim 3 wherein said bottom wall includes a pair of offset bottom wall portions, one of said offset bottom wall portions closing said drawer in the closed position of said drawer, and another of said offset bottom wall portions occupying said generally common plane.

6. The pocket container as defined in claim 5 wherein said first cover includes a pair of generally spaced parallel side walls; said drawer includes a front wall; and one of said first cover and body side walls are in a common plane with said drawer front wall in a closed position of said drawer.

7. The pocket container as defined in claim 6 wherein said first and second pivots lie on opposite sides of a plane through said body bottom wall.

8. The pocket container as defined in claim 2 wherein said first cover includes a pair of generally spaced parallel side walls; said drawer includes a front wall; and one of said first cover and body side walls are in a common plane with said drawer front wall in a closed position of said drawer.

9. The pocket container as defined in claim 8 wherein said bottom wall includes a pair of offset bottom wall portions, one of said offset bottom wall portions closing said drawer in the closed position of said drawer, and another of said offset bottom wall portions occupying said generally common plane.

10. The pocket container as defined in claim 8 wherein said first and second pivots lie on opposite sides of a plane through said body bottom wall.

11. The pocket container as defined in claim 2 wherein said bottom wall includes a pair of offset bottom wall portions, one of said offset bottom wall portions closing said drawer in the closed position of said drawer, and another of said offset bottom wall portions occupying said generally common plane.

12. The pocket container as defined in claim 1 wherein said oblique plane defines an acute angle with said generally common plane, and said acute angle opens in a direction toward said first pivot.

13. The pocket container as defined in claim 1 wherein said first cover includes a pair of generally spaced parallel side walls; said drawer includes a front wall; and one of said first cover and body side walls are in a common plane with said drawer front wall in a closed position of said drawer.

14. The pocket container as defined in claim 1 wherein said bottom wall includes a pair of offset bottom wall portions, one of said offset bottom wall portions closing said drawer in the closed position of said drawer, and another of said offset bottom wall portions occupying said generally common plane.

15. The pocket container as defined in claim 1 wherein said first and second pivots lie on opposite sides of a plane through said body bottom wall.

* * * * *